US005896605A

United States Patent [19]

Branman

[11] Patent Number: 5,896,605

[45] Date of Patent: Apr. 27, 1999

[54] BED MATTRESS AND METHOD OF CONSTRUCTION

[76] Inventor: Jeffrey M. Branman, 140 Buckthorn Dr., Brea, Calif. 92621

[21] Appl. No.: 08/690,002

[22] Filed: Aug. 1, 1996

Related U.S. Application Data

[63] Continuation-in-part of application No. 08/333,525, Nov. 2, 1994, abandoned.

[51] Int. Cl.[6] ..... A47G 9/00

[52] U.S. Cl. ..... 5/716; 5/717; 5/724; 5/723

[58] Field of Search ..... 5/716, 655.7, 654.1, 5/230, 246, 717, 724, 703, 723, 738, 485, 639, 931, 694

[56] References Cited

U.S. PATENT DOCUMENTS

| | | | |
|---|---|---|---|
| D. 358,284 | 5/1995 | Hill | 5/931 |
| 2,118,486 | 5/1938 | Buchman | 5/639 |
| 2,217,955 | 10/1940 | Kay . | |
| 2,293,730 | 8/1942 | Beehler | 5/639 |
| 2,399,628 | 4/1946 | Cunningham . | |
| 2,611,910 | 6/1952 | Bell . | |
| 2,629,111 | 2/1953 | Korney | 5/716 |
| 2,651,788 | 9/1953 | Forwood | 5/716 |
| 2,978,715 | 4/1961 | Blecker | 5/716 |
| 3,089,154 | 5/1963 | Boyles | 5/716 |
| 3,287,749 | 11/1966 | Marsico . | |
| 3,493,980 | 2/1970 | Haller | 5/639 |
| 3,950,800 | 4/1976 | Garshfield . | |
| 4,164,797 | 8/1979 | Golembeck . | |
| 4,365,371 | 12/1982 | Boussaroque | 5/738 |
| 4,462,129 | 7/1984 | Brannock . | |
| 4,490,866 | 1/1985 | Stanton . | |
| 4,590,632 | 5/1986 | Meyer | 5/694 |
| 4,788,731 | 12/1988 | Yokoi et al. | 5/716 |
| 4,809,375 | 3/1989 | Bull . | |
| 5,007,123 | 4/1991 | Salyards . | |
| 5,111,544 | 5/1992 | Graebe | 5/485 |
| 5,150,722 | 9/1992 | Rutherford . | |
| 5,222,264 | 6/1993 | Morry . | |
| 5,416,936 | 5/1995 | Chan . | |

OTHER PUBLICATIONS

Sales brochure from United Mattress Machinery for the NR Tape Edge Machine, Jul. 1994.

*Primary Examiner*—Kenneth J. Dorner
*Assistant Examiner*—Fredrick Conley
*Attorney, Agent, or Firm*—Knobbe, Martens, Olson, Bear, LLP

[57] ABSTRACT

A bed mattress provides a zippered border attachment providing access to a hidden compartment on the interior of the mattress. The border may be completely or partially separable from the top mattress cover to allow inspection of the spring unit or to access the interior space of the mattress. In the all-around zipper construction of one preferred embodiment, the outer covers are pre-assembled without expensive machinery and allow a large inventory to be maintained comprising different mattress components. The hidden compartment preferably has its own zipper closure and may be formed to have two or more inner pockets. A pair of handles may be provided on the exterior of the border at about the ends of the pocket to overlap the pocket seams and help hide the presence of the compartment.

11 Claims, 5 Drawing Sheets

BED MATTRESS AND METHOD OF CONSTRUCTION

RELATED APPLICATION

This is a continuation-in-part of U.S. application Ser. No. 08/333,525, filed Nov. 2, 1994 now abandoned, entitled BED MATTRESS AND METHOD OF CONSTRUCTION.

BACKGROUND OF THE INVENTION

The present invention relates to a type of bed mattress and a method of constructing same, and in particular to a mattress which allows an end user to access the interior of the mattress.

The conventional inner construction of present bed mattresses includes an inner coil spring unit surrounded on the top and bottom by padding which provides a barrier and cushion against the metal springs. In better quality mattresses a wire grid is further provided as a barrier between the padding and the spring unit. The padding is then padded on its top and bottom by layers of foam, cotton, and other materials. The typical outer construction of a mattress includes a top and bottom cover, and a border which surrounds the four sides or perimeter of the spring unit. The covers and border are usually quilted fabric available in a variety of colors and print patterns, thus providing the initial aesthetic appeal to the customer.

A flange formed by a strip of strong fabric is attached to the boundaries or peripheries of the top and bottom covers prior to the final assembly of the mattress. The top and bottom flanges extend over the side edges of the spring unit and are anchored to the springs using metal rings, commonly referred to as "hog rings". The flanges fix the padded layers in place on the top and bottom of the spring unit, so that during prolonged use the various layers are not dislodged. The flanges also serve to resist the tensile forces around the perimeter of the bed resulting from a body resting on top of the mattress.

A specialized tape edge machine, mounted on a special table, is used to attach the border to the top and bottom covers after the flanges of the covers have been attached to the spring unit. Wads of cotton material are often inserted just prior to the covers' attachment in order to round and pad the corners of the mattress. Also, stiffening members may be affixed to upper and lower border rods along the mattress sides prior to final assembly, for people who sit on the edge of the bed and require extra support therein.

In the final assembly of the mattress, a decorative tape is folded over the raw edges of the cover, flange, and border materials by an operator. The operator must manually position the tape over the raw edges while walking backward, as the machine moves around the mattress and stitches the tape to form a welt around the mattress perimeter. This is done for the top cover attachment to the border, and also for the bottom cover attachment to the border. The tape edge machine and its required components are quite costly, and a highly skilled operator is required to produce quality mattresses.

There are some fold-away mattresses for sofa beds or Murphy (wall) beds which use a "bucket" construction. In this construction only a top cover has a flange which is anchored to an inner spring unit. A bottom cover and border are sewn together and the inner spring unit placed within. The tape edge machine is then used to attach the top cover to the top of the border. Even less expensive fold-away mattresses may use a foam unit within the bucket construction and completely omit the use of flanges. However, none of these fold-away mattresses allow access to the interior after final assembly of the mattress.

The flange construction also does not apply to water beds, where an outer cover may be separately constructed and then attached over the water mattress without the special machinery and technique described above. This is because the typical water bed mattress has a foam border construction which provides the functions of fixation and force resistance that flanges provide. That is, water beds do not require flanges and therefore do not require the special machinery or skilled labor.

There also are mattresses presently available which allow the top cover to be reversed, although this still does not provide access to the interior. Velcro or other such means is provided on the top of an upper mattress cover, over which a separable panel is placed. This panel may be padded or quilted, or a thick wool material may be attached on one side. This reversible construction is an additional feature that is independent of the attachment of the mattress outer covers during final assembly.

Most of the components for bed mattresses, such as the quilted material, foam, padded layers, and spring units are readily available from several sources. In fact, many mattress manufacturers simply obtain these components and perform only the flange and border attaching procedures on site. That is, the manufacturers provide only the final assembly of the mattresses.

However, because of limited storage space and for inventory control, only certain combinations of springs/padding/foam/quilted covers are usually maintained by each manufacturer. These are usually stored in intermediate stages of assembly, so that customization of a mattress—i.e., using a different padding or quilted cover requires a lengthy wait to fulfill the custom order. Thus, consumers are quite limited in the immediate selection afforded by the present mattress manufacturers and retailers, unless a great amount of time and money is willing to be spent to obtain the ideal mattress construction.

Not only is the customer limited in his choice from what is available from a particular dealer, as either a custom order or from stock, the customer must take the salesperson's word that the interior construction of the mattress the customer takes home is the same as the mattress displayed in the store. That is because the inner construction of the mattress is obscured once final assembly of the border to the top and bottom covers is completed, so that the consumer is blind as to the actual construction of both the store's displayed mattresses and his own mattress once it is at his home. While the outer covers are easily verified, at least for the color/pattern and quilting style, the true worth—and cost—of the mattress is in the padding and spring unit construction which are the most important elements for restful sleep and for durability.

A further problem with present mattresses is that any moisture absorbed by the mattress results in time spent drying the mattress, as well as possible mildew or other lingering odors. The moisture may be from a spilled glass of water, or a buildup of normal bodily secretions over time. Two ways presently used to avoid or reduce wetness and odor are the use of waterproof sheets and the presence of vent holes on the sides of the mattress. The sheets prevent moisture from being absorbed by the mattress, but only if positioned over all possible areas of wetness. The vent holes allow some ventilation of the interior of the mattress to speed drying somewhat, but may not completely prevent odors from resulting.

SUMMARY OF THE INVENTION

A bed mattress and its method of construction in the present invention provide convenient access to the interior of the mattress and, in particular, to a hidden compartment or pocket contained therein. A border of the mattress is completely or partially separable from a top mattress cover using a releasable fastener such as a zipper. The pocket may have its own releasable closure and may be formed on the inside of the border to have more than one storage area.

In one preferred embodiment, a mattress constructed in accordance with the present invention is comprised of first and second outer covers with flanges attached thereto, a border, a releasable fastener and an inner support member. The border has an exposed side and an enclosed side, and a pocket is preferably provided on its enclosed side. The pocket preferably has a zipper closure. The support member includes an innerspring coil unit, the flanges being used to secure the outer first and second covers to the innerspring coil unit, preferably using hog rings. Optionally, handles are formed on the exposed side of the border at substantially the ends of the pocket and at least partially obscure the stitching of the pocket ends onto the border.

In another embodiment, a mattress constructed in accordance with the present invention is comprised of top and bottom outer covers with flanges attached thereto, a border, a releasable fastener and an inner support member. The border has an exposed side and an enclosed side, and a pocket is preferably provided on its enclosed side. The top and bottom outer covers, with flange material attached to their perimeters and with its attached border, are pre-assembled with the releasable fastener extending substantially the entirety of the mattress perimeter. The flange is used to secure the outer covers to an innerspring coil unit of the support member. Final assembly of the mattress is complete when the releasable fastener is fastened to close the mattress border.

A preferred method of constructing a mattress of the present invention comprises providing a border with a pocket or compartment on an interior-facing side of the border. Flanges are attached to the outer covers. One half of a releasable fastener is attached to a portion of the upper outer cover and extends substantially the length of the pocket and less than the length of one of the two lateral sides of the mattress. The other half of the fastener is attached to the border adjacent the opening side of the pocket. The flanges are secured to the innerspring coil unit, and the remainder of the border is securely attached to the remaining perimeters of the outer covers. Fabric handles may be attached at the ends of the pocket, on the exposed side of the border, prior to the attachment of the border to the outer covers.

Another preferred method of constructing a mattress of the present invention begins by attaching the flanges to the outer covers. One half of the fastener is attached to one of the covers. A pocket is formed on an enclosed side of the border and preferably has a zipper closure. One edge of the border is attached to the other cover, and the other half of the fastener is attached to the other edge of the border. These attachment steps can be performed on regular industrial sewing machines and they are not relatively costly. Next, one cover is placed over each sleeping side of the support member and the cover's flange is anchored to the spring unit over its side edges. Finally, the border is pulled up to envelop the sides of the spring unit, and the two halves of the fastener are joined, thus enclosing the pocket of the border inside the mattress.

In a preferred method of manufacturing and marketing a mattress of the present invention, the manufacturer or retailer can stack prefabricated mattress components and assemble the components after customer selection. This significantly reduces inventory storage and display space requirements. The customer has ready visibility by means of the releasable fastener as to the inner construction of the mattress he has purchased, and can thus verify that he got his money's worth. The customer also has access to the mattress interior to both help speed its drying and to take care of any odor problems.

Further advantages and applications will become apparent to those skilled in the art from the following detailed description of the preferred embodiments and the drawings referenced herein, the invention not being limited to any particular embodiment.

DETAILED DESCRIPTION OF THE PREFERRED EMBODIMENTS

A preferred embodiment of a bed mattress and method of its construction in the present invention provides a zippered border attachment providing access to a hidden compartment of the mattress. The border may be partially or completely separable from the top mattress cover. The compartment formed in the border of the mattress preferably has its own zipper closure and may be formed to have more than one inner storage area. A pair of handles may be provided on the exterior of the border at about the ends of the pocket to overlap the pocket seams and help hide the presence of the compartment on the mattress border.

Overview of Mattress Construction

Figure 1:
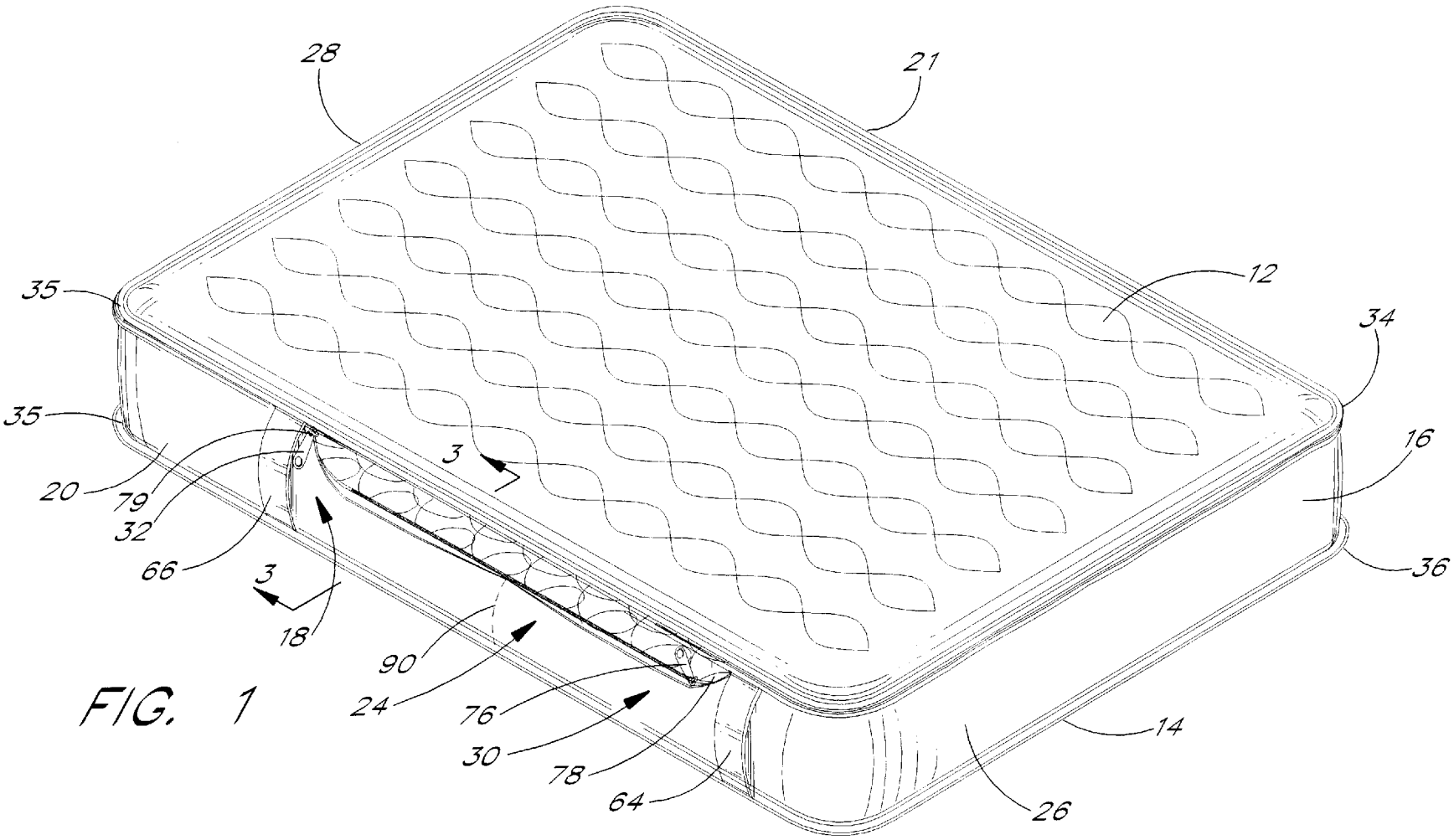
FIG. 1 is a perspective view of a first preferred embodiment of a bed mattress constructed in accordance with the present invention.

Referring now to FIG. 1, a mattress 10 has a top outer cover 12 on one sleeping side, and a bottom outer cover 14 that is hidden from view on the other side. A border 16 surrounds the perimeter of the mattress 10, between the top and bottom covers 12, 14, and a zipper 18 joins the top cover 12 to the border 16 along a portion of a lateral side 20 of the mattress 10. The top 12, bottom 14, and border 16 are preferably coordinating quilted fabric that has been pre-cut for standard mattress sizes prior to the assembly which is described below.

Figure 2:
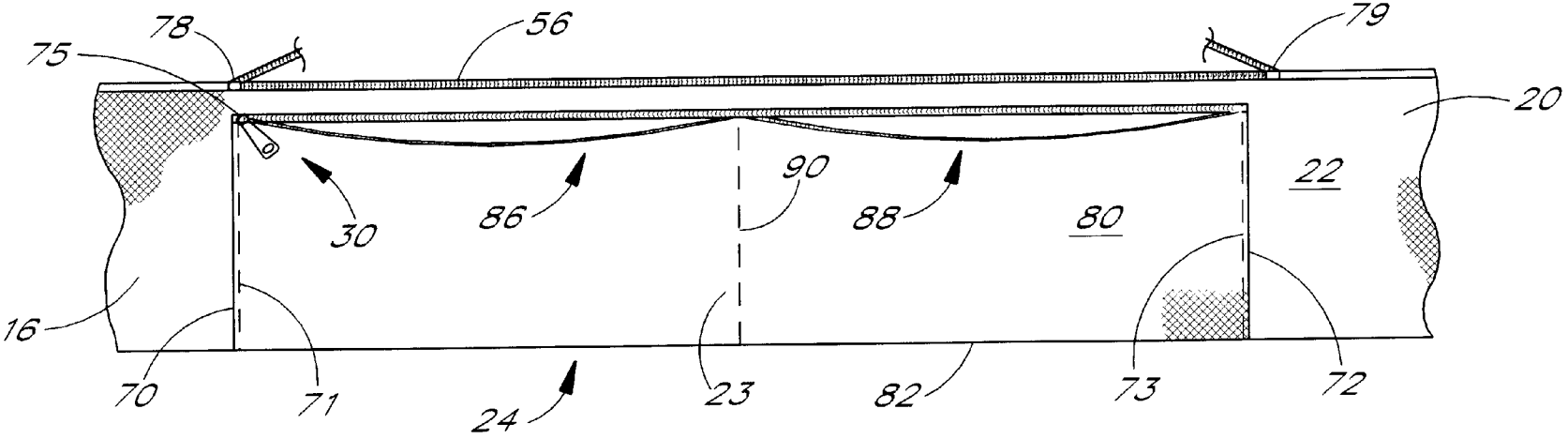
FIG. 2 is an elevational view of the interior of the border of the mattress of FIG. 1, showing a zippered inner pocket having stitching to bisect the pocket into two storage areas.

As shown in FIG. 2, the border 16 has an interior-facing, or enclosed, side 22 to which is attached a separate layer of fabric 23, which with the side 22 forms a storage compartment or pocket 24. The compartment 24 is hidden after final assembly of the mattress 10. The pocket 24 is preferably about 36 inches in length and located slightly closer to one of the ends 26, 28 of the mattress 10 than the other. This placement of the pocket 24 helps to position it within closer reach of a person laying on top of the mattress. Of course, the pocket 24 may be centrally located along one of the longer, lateral sides 20, 21 of the mattress 10 in alternative embodiments of the present invention.

It is preferred that the pocket 24 have its own closure 30 provided on the enclosed side 22 of the border 16. The pocket closure 30 is preferably a zipper; although, other fasteners known to those skilled in the art may alternatively be used. The pocket zipper 30 preferably opens at the end of the pocket which is closest to a mattress zipper tab 32 when the mattress zipper 18 is opened to allow access to the mattress interior. This allows easier and faster access to the pocket zipper 30 after opening the mattress zipper 18.

Figure 3:
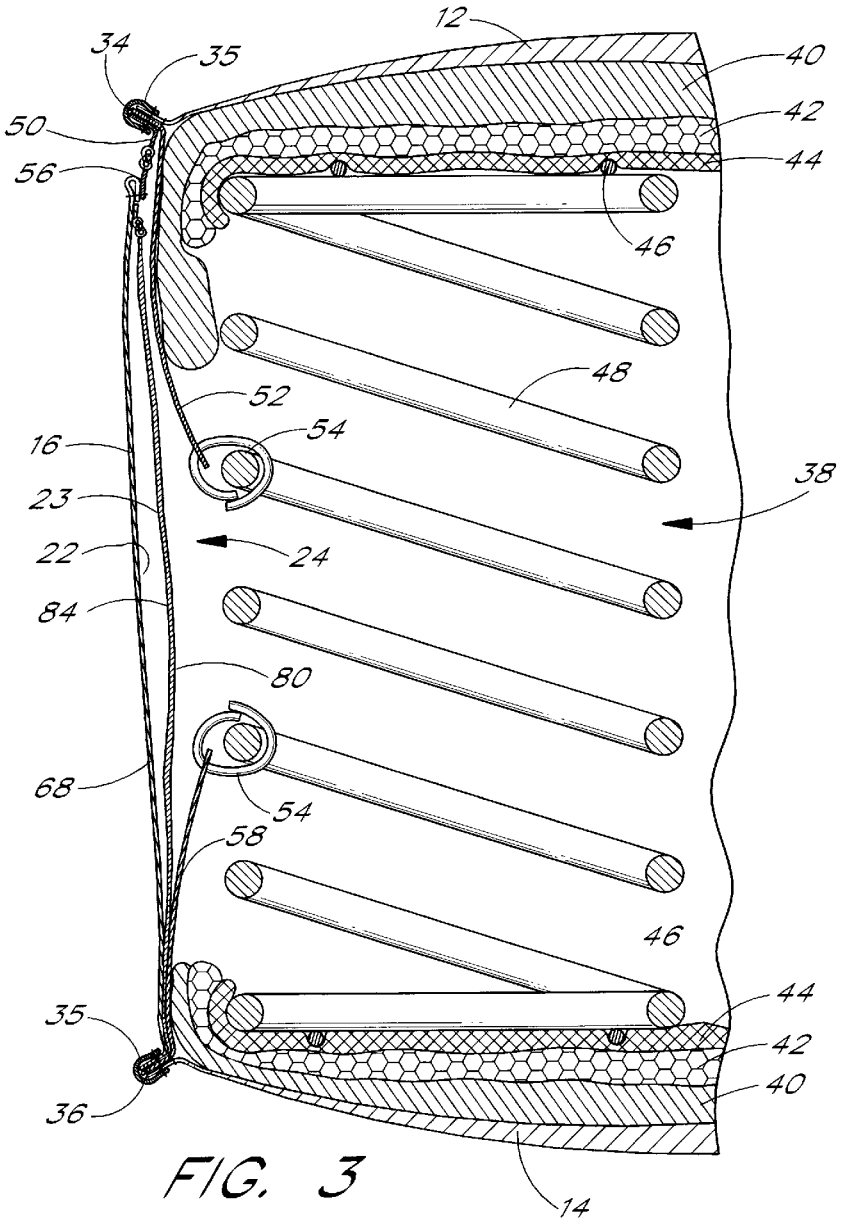
FIG. 3 is a cross-sectional view taken along lines 3—3 of the bed mattress of FIG. 1.

As more clearly shown in FIG. 3, the peripheries of the top and bottom covers 12, 14 preferably have welts 34, 36. In the preferred embodiment of FIG. 4, for example, welts are not necessary but may be included as a decorative feature which is expected by the consumer.

Mattress Components

The preferred components of the mattress constructed in accordance with the present invention are illustrated in FIG. 3. Layers of padding are placed between the covers 12, 14 and a coil spring unit 38, with the layers repeated in order on the unit's two sleeping sides. Like better quality mattresses, the mattress of the preferred embodiments includes a foam pad 40, a cotton pad 42, a padding 44, and a grid 46 which is placed closest to springs 48 of the unit 38.

The grid 46 may be formed of plastic or wire. The grid 46 preferably covers the entire sleeping surface of the spring unit 38, although it may also be used to cover only the central third portion. The grid 46 is attached to the springs 48 of the unit 38 using hog rings (not shown). The grid 46 is a barrier to prevent the fabric layers from being pushed into the springs 48. The preferred grid 46 is available from Leggett and Platt, Inc. of Carthage, Mis., and uses twist-wrap paper around steel wires to form the grid spacing.

The padding 44 is typically fabricated from scrap material available from the garment industry, such as polyester, which is shredded and impregnated with latex. This material is heated and pressed to form a roll which is then cut to standard dimensions used by the mattress industry. The padding 44 adds a cushioning layer, and it prevents the foam and cotton pads 40, 42 from becoming lodged in, or pushed through, the grid 46 and/or the springs 48. The padding 44 may be obtained from several sources, such as Permafirm Pad Co., in Los Angeles, Calif.

Referring now to FIGS. 1 and 3, one half of a zipper 50 is attached below the welt 34 on the top cover 12. In addition, the top cover 12 has a flange 52 attached that is anchored to the spring unit 38 using hog rings 54. Another zipper half 56 (FIG. 2) is attached to the edge of the border 16 that will fasten to the other zipper half 50. Another flange 58 is attached to the periphery of the bottom cover 14 and is covered by the border 16.

Figure 3A:
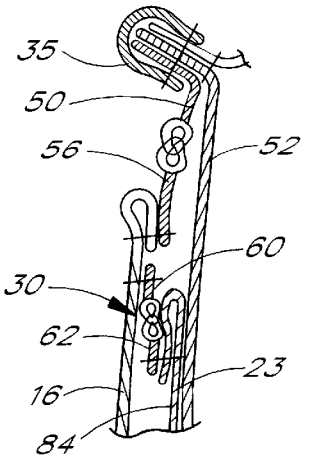
FIG. 3*a* is a detail view of the cross-section of FIG. 3 showing the pocket zipper attachment to the border.

As shown in FIGS. 3 and 3*a*, a pocket zipper 30 comprises a first half 60 which is attached to the enclosed side 22 of the border 16, just below the mattress zipper half 56 that is attached to the border edge. The second half 62 of the pocket zipper 30 is attached to the opening edge of the pocket layer 23. The opposite edge of the pocket layer 23 is attached between the flange 58 and the border 16 to the bottom cover 14.

In the preferred embodiment of FIG. 1, the mattress zipper 18 extends along the perimeter of the top cover 12 slightly longer than the pocket zipper 30. A pair of handles 64, 66 are formed on the exposed side 68 of the border 16, at the pocket ends 70, 72. As discussed with reference to the preferred embodiment of FIG. 4, the mattress zipper 18 may alternatively extend around substantially the entire perimeter of the mattress.

Zippers are available from manufacturers in rolls which are cut to the length required, and they may be of metal or nylon construction. A pre-sized, pre-mated zipper 30 may be used which already has end clips 74, 75 and a pull tab 76 attached. Alternatively, the halves of the zipper are attached to the cover, border or pocket, with their teeth aligned such that a pull tab is then attached which meshes the teeth together and closes the zipper. The alignment is simplified by the fact that the teeth are spaced close together. The ends of the zipper are then finished using end clips, which provide stops for the pull tab during use. Or, a combination of techniques may be employed, such as having the pocket zipper 30 pre-mated, while the end clips 78, 79 and pull tab 32 are attached to the mattress zipper 18 during assembly of the mattress 10. Although zippers are utilized in the preferred embodiment of the present invention, it is obvious to those skilled in the art that other releasable fasteners, such as Velcro or other releasable tape, may be substituted.

The flanges 52, 58 are of non-woven material known to those skilled in the art. They provide affixation of the quilted covers 12, 14 and padded layers 40, 42, 44 over the spring unit 38. The flanges 52, 58 also resist the tensile forces at the side edges of the top and bottom of the mattress, rather than allowing the forces to be transmitted to the border fabric. In an alternate embodiment, the flanges 52, 58 could be replaced by separate, inner covers extending the entirety of the top and bottom of the spring unit 38 and padding 40, 42, 44 and having extensions or flaps for anchoring to the springs 48. However, this is an expensive alternative that does not improve on the flange construction used herein.

Although a single, quilted fabric is described and shown herein for the outer covers 12, 14, border 16 and pocket 24, it is understood by those skilled in the art that mixed fabric types may be used for the mattress. Similarly, tape binding or edging 35 used to form the welts 34, 36 may be of coordinating or contrasting fabric and color. Further, the welts 34, 36 around the perimeters of the top and bottom of the mattress may be replaced by cording, by the fabric itself (self welts), or even eliminated, as well known to those skilled in the art.

Although not shown in FIG. 3, additional components which may be added between the spring unit 38 and the border 16 include wads of cotton material (at the corners) and support members (along the mattress perimeter). Differences in the type or number of components utilized within the mattress, such as the wire grid 46, may be included in alternative embodiments of the present invention.

Preferred Methods of Construction

The covers 12, 14, border 16, and padded layers 40, 42, 44 are cut to predetermined sizes, and the welt tape 35 and zipper 18 are available in rolls for cutting to any desired length. Each of these components, and the spring units 38, are available from various sources. The pocket 24 is preferably formed from material from the same source as the border 16 and outer covers 12, 14 and is preferably cut to a standard size. Thus, the manufacturer is able to maintain a greater inventory of the mattress components in disassembled state than would be available with conventional manufacturing and allowing a much wider range of custom combinations.

Figure 4:
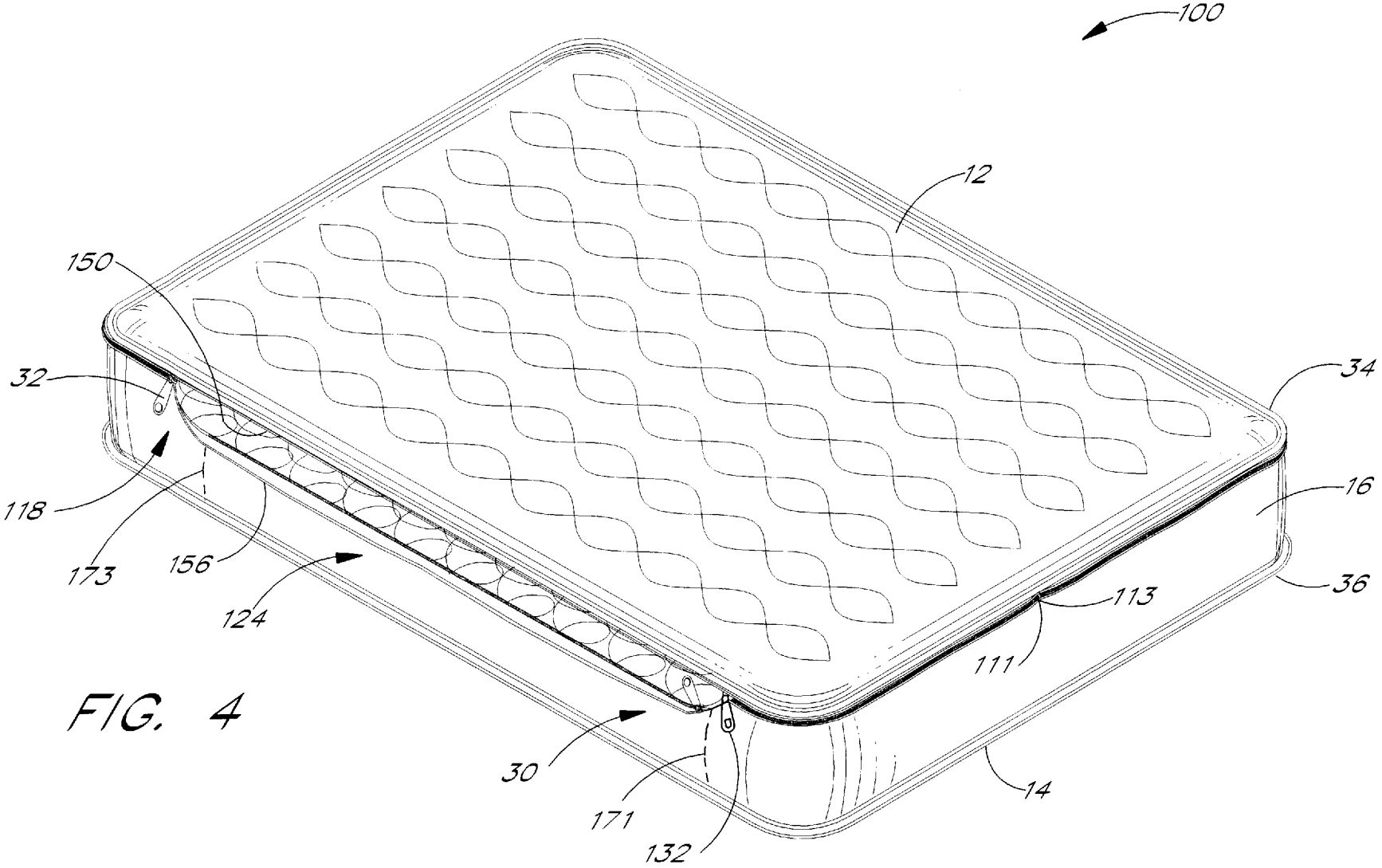
FIG. 4 is a perspective view of a second preferred embodiment of a bed mattress constructed in accordance with the present invention.
Figure 5:
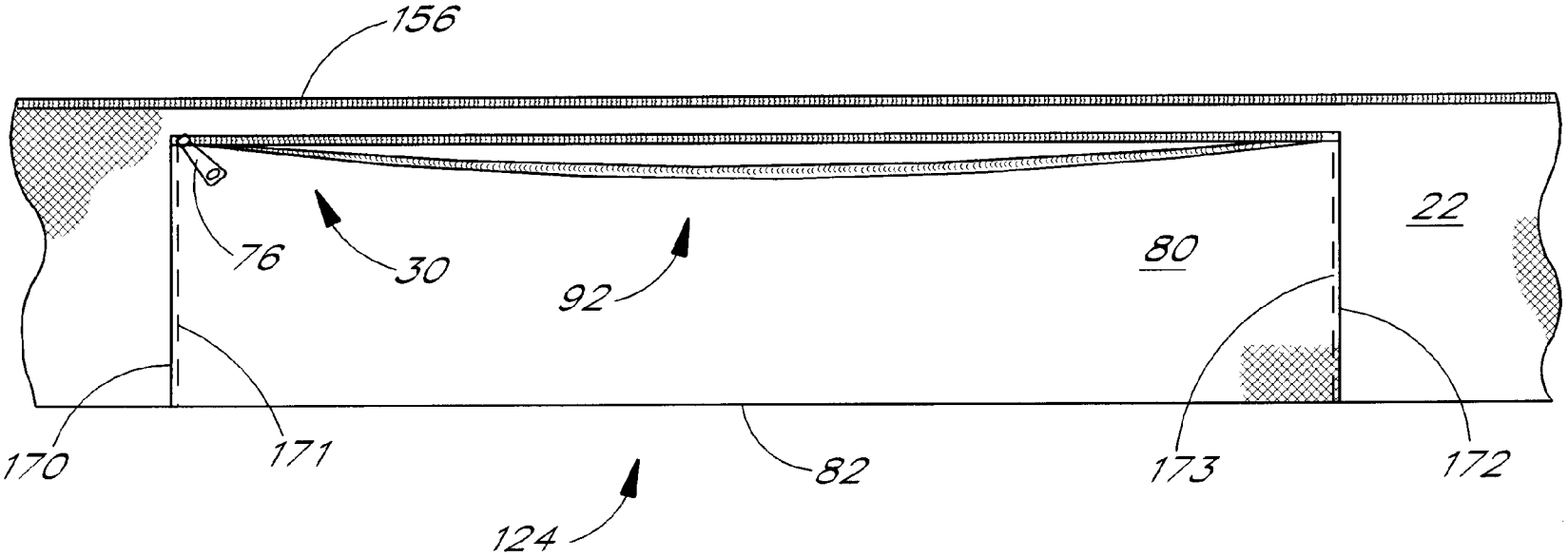
FIG. 5 is an elevational view of the interior of the border of the mattress of FIG. 4.

The pocket layer 23 is preferably formed of a substantially rectangular section of the same material as the border 16 and outer covers 12, 14. One of its long sides has one half 62 of the pocket zipper 30 attached along its length and forms the opening edge of the pocket 24. The pocket layer 23 is sewn along its two shorter sides 70, 72 to the unfinished side 22 of the border 16 with the finished side 80 of the pocket layer 23 facing the interior of the mattress 10. The remaining long side 82 of the pocket layer 23 is stitched with the border 16 to the bottom cover 14, covering the bottom flange 58. Thus, the unfinished side 84 of the pocket layer 23 contacts the enclosed, unfinished side 22 of the border 16. In the embodiment of FIGS. 1 and 2, two storage areas 86, 88 are formed by stitching the pocket 24 at approximately the middle of its length, and the seam line 90 is visible on the exposed side 68 of the border 16. Alternatively, as shown in the embodiment of FIGS. 4 and 5, a pocket 124 may comprise a single storage area 92 not having the bisecting seam line. It is understood that the pocket may comprise any number of storage areas in the present invention.

In the preferred embodiment of FIG. 1, the foam pad 40, cotton pad 42, padding 44, and grid 46 are layered over the springs 48. The flanges 52, 58 are attached to the perimeters of the top and bottom covers 12, 14 and secured to the springs 48 using hog rings 54. The top and bottom covers 12, 14 secure the grid 46 and padded layers 40, 42, 44 over the spring unit 38. The pocket 24 is formed on the enclosed, unfinished side 22 of the border 16, and handles 64, 66 are attached to the exposed, finished side 68 of the border 16, over the seam lines 71, 73 at the pocket ends 70, 72.

Preferably, the mattress zipper 18 is attached to the border 16 adjacent the opening edge of the pocket 24, and the mattress zipper 18 is closed during attachment of the border 16 to the outer covers 12, 14. As illustrated in FIG. 3, the upper edge of the border 16 adjacent the mattress zipper 18 is folded and forms a flap, and the lower zipper half 56 is attached to an underside of the border 16. The border 16 is conventionally attached to the top and bottom covers 12, 14 using tape 35 and the necessary machinery to form the welts 34, 36, except that the top cover 12 is attached to the upper mattress zipper half 50 rather than directly to the border 16 along the length of the mattress zipper 18. Preferably, the ends of the handles 64, 66 are included in the material enclosed by the tape 35 to form the welts 34, 36 around the top and bottom covers 12, 14 of the mattress 10. In alternative embodiments, the upper mattress zipper half 50 may be sewn to the top cover 12 prior to the attachment of the border 16 to the covers 12, 14 and then later mated to its lower zipper half 56. Also, the handles 64, 66, if provided, may be attached only to the border 16 and not the covers 12, 14.

Referring to an alternative embodiment shown in FIG. 4, the top cover 12, the top zipper half 150, flange 52 and tape 35 are attached together before the flange 52 is anchored to the spring unit 38. The pre-assembly of the top of the mattress 100 begins with the flange 52 sewn to the underside of the top cover 12, such that their edges are pointing outward, as shown more clearly in FIG. 3. Next, the zipper half 150 is placed next to the flange 52 so that its teeth are pointing inward, toward the center of the cover 12. Preferably, the ends 111 of the zipper half 150 overlap slightly, midway along one of the shorter sides of the cover 12. The tape 35 is folded over the edges of the cover 12, flange 52, and zipper half 150 and sewn in place, thus forming the welt 34.

The pocket 124 is formed on the border 16 as described above. The flange 58 is sewn to the bottom cover 14 in the same manner as the flange 52 and top cover 12 were sewn together. Instead of part of the zipper 118, the border 16 is attached to the bottom cover 14, and the bottom cover 14, border 16, and flange 58 are sewn together using the tape 35 and thus form the welt 36. As described above, the upper edge of the border 16 is folded and forms a flap, and the other zipper half 156 is attached to an underside of the border 16. The zipper half 156 is placed under the flap so that its teeth are positioned just inside the fold, facing outward for engagement with the top zipper teeth. As before, the ends 113 of the zipper half 156 overlap slightly at approximately the middle of one of the short sides of the top cover 12. The flap provides cover for the zipper 118 after its closure.

The border 16 is pulled away, downward, in order to attach the hog rings 54 of the bottom flange 58 to the spring unit 38. After the flanges 52, 58 are attached, pull tabs 32, 132 are engaged over the teeth of the mattress zipper 118 to allow opening of the zipper in either the left or right direction, and end clips are attached at start and stop, overlapped ends 111, 113 of the zipper 118. Thus, the remaining step in the final assembly of the mattress 100 is closing the zipper 118. As shown in FIG. 4, the two pull tabs are preferably positioned to allow opening of the covers at the location of the pocket 124. In alternative embodiments, the ends 111, 113 of the zipper 118 may be located at about one of the ends 170, 172 of the pocket 124 on the lateral side of the mattress so that only one pull tab 32 is required. In embodiments not having handles formed on the border 16 at the pocket ends 170, 172, seams 171, 173 are visible from the attachment of the pocket 124 to the enclosed side 22 of the border 16.

The "top" cover and "bottom" cover designations used herein may be reversed in alternate embodiments. That is, the top cover 12 may be pre-attached to the border 16, and the bottom cover 14 may have the zipper half 50, 150 attached at the tape 35. While positioning the zipper 18, 118 at the boundary of the border 16 is clearly the preferred location, it could of course be at other locations in the border 16, such as the middle. In this embodiment, storage compartments may be formed in one or both lateral halves of the border 16. Also, in alternative embodiments, there may be zippers attaching the border 16 to both the top and bottom covers 12, 14, and the pocket 24, 124 may have zippers along both its long sides, to accommodate rotation of the mattress 10, 100 such as recommended by mattress manufacturers to prolong the life of the spring unit 38. Further, in the present invention, multiple storage areas of the pocket 24, 124 on the border 16 may have separate closures for each.

Thus, the mattress customer is able to open the border cover to access the interior of the mattress, and, particularly, a hidden compartment. A variety of items may be placed in this storage area, including firearms, jewelry, coins, currency or other valuables. In addition, the problem of moisture and odors can be reduced or eliminated, since there is access to the interior of the mattress. Silica gel packs can be put into the mattress to absorb moisture. Or, fragrance beads may be added to aromatize the bed. In another embodiment, a reversible top cover could be added to the top cover of the present invention as an added feature to the aforementioned attributes and advantages.

In a method of manufacturing and marketing of the present invention, a first quantity of mattress components is prepared, including i) one side of a mattress cover with a flange attached to the perimeter of the cover, ii) a border extending over the flange with one edge attached to the cover perimeter, and iii) a portion of a releasable fastener attached to the opposite edge of the border. Also, a second quantity of mattress components is prepared, including the other side of a mattress cover with a flange attached to its perimeter, and with a second portion of the fastener attached to the mattress cover other side. Next, a customer is allowed to select a desired mattress cover component from each of the quantities, as well as a desired mattress inner support member, which includes a spring unit and whatever padding elements are desired for the support member.

The selected cover components are positioned onto the selected support member which includes the selected spring unit, and the flanges are attached to the selected spring unit to secure the covers with respect to the selected support member. The fastener portions are then joined to complete the mattress, in a condition that will permit the customer to have easy access to the mattress interior by unfastening the fastener. Thus, in the store, the customer can see as well as feel what he wants and more intelligently decide what he needs in a mattress. And, at home, the customer is assured he has the mattress he ordered.

The embodiments described above are provided merely to illustrate the present invention. Changes and modifications may be made from the embodiments presented herein by those skilled in the art without departure from the spirit and scope of the invention, as defined by the appended claims. For example the secret pocket disclosed may be in various locations in or on the mattress rather than merely the preferred arrangements illustrated.

What is claimed is:

1. A mattress comprising:

an inner spring unit;

a top cover being the uppermost layer of the mattress and having a flange attached for affixing to said spring unit;

a bottom cover being the lowermost layer of the mattress and having a flange attached for affixing to said spring unit;

a border surrounding said spring unit and attached to said covers, the border not being attached to said spring unit except through said covers, said border having an inner surface and an outer surface;

a releasable fastener joining at least a portion of one of said covers to said border, said fastener being releasable to separate said portion of said border from one of said covers to allow visual access to said spring unit in the interior of said mattress so that a purchaser can observe the construction of the spring unit; and a pocket attached to said inner surface of said border to form a storage compartment located between said spring unit and said border said pocket being accessible by releasing said portion of said border and being hidden from view when said fastener joins said border portion to said one of said covers.

2. The mattress of claim 1, wherein said pocket is on an enclosed side of said border and is closed using a zipper.

3. The mattress of claim 2, wherein said pocket forms two compartments and said zipper closes both.

4. The mattress of claim 1, wherein said fastener is a zipper and said border is sewn to at least one of said covers before it is attached to said spring unit, said zipper being connected to said border and completing the joining of said covers.

5. The mattress of claim 1, wherein said pocket is formed by securing a layer of material to said enclosed side of said border.

6. A mattress comprising:

an inner spring unit;

a top cover having a flange attached for affixing to said spring unit;

a bottom cover having a flange attached for affixing to said spring unit;

a border having an exterior exposed side and a hidden enclosed side which is open and easily accessible to said spring unit and attached to said top and bottom covers, a pocket attached to said enclosed side of said border and positioned between the border and the spring unit; and a releasable fastener attaching said border to said affixed top cover in the area of said pocket, said fastener being releasable to separate said border from said affixed cover to allow physical access to said pocket and visual access to the interior of said mattress so that a purchaser may observe the construction of the spring unit.

7. The mattress of claim 6, wherein said pocket is closed using a zipper.

8. The mattress of claim 7, wherein said pocket forms two compartments and said zipper closes both compartments.

9. The mattress of claim 6, wherein said fastener is a zipper.

10. The mattress of claim 6, further comprising a pair of handles provided on said exposed side of said border attached to said affixed covers at substantially the ends of said pocket spaced along the length of said mattress.

11. The mattress of claim 6, wherein said pocket is formed by a layer of material secured to said enclosed side of said border.

* * * * *